US009988185B2

(12) United States Patent
Liberman et al.

(10) Patent No.: US 9,988,185 B2
(45) Date of Patent: Jun. 5, 2018

(54) SOFT FOOD SHAPING AND STORAGE CONTAINER

(71) Applicants: Maya Barbara Liberman, Oakville (CA); Gregory Daniel Liberman, Oakville (CA)

(72) Inventors: Maya Barbara Liberman, Oakville (CA); Gregory Daniel Liberman, Oakville (CA)

(73) Assignee: SMART COOKIE HOME ESSENTIALS INC., Oakville (CA)

( * ) Notice: Subject to any disclaimer, the term of this patent is extended or adjusted under 35 U.S.C. 154(b) by 0 days. days.

(21) Appl. No.: 15/616,088

(22) Filed: Jun. 7, 2017

(65) Prior Publication Data

US 2017/0267406 A1 Sep. 21, 2017

Related U.S. Application Data

(63) Continuation of application No. 14/804,263, filed on Jul. 20, 2015, now Pat. No. 9,708,102.

(51) Int. Cl.

| | |
|---|---|
| ***B65D 25/04*** | (2006.01) |
| ***B65D 85/72*** | (2006.01) |
| ***B65D 81/18*** | (2006.01) |
| ***B65D 43/02*** | (2006.01) |

(52) U.S. Cl.

CPC ..... *B65D 25/04* (2013.01); *B65D 43/021* (2013.01); *B65D 81/18* (2013.01); *B65D 85/72* (2013.01); *B65D 2543/0037* (2013.01); *B65D 2543/00037* (2013.01); *B65D 2543/0062* (2013.01); *B65D 2543/00101* (2013.01); *B65D 2543/00296* (2013.01); *B65D 2543/00518* (2013.01); *B65D 2543/00685* (2013.01); *B65D 2543/00796* (2013.01)

(58) Field of Classification Search

CPC .... B65D 25/04; B65D 43/0212; B65D 85/72; B65D 2543/00203; B65D 2543/00296

USPC ..... 220/507; 206/538, 540

See application file for complete search history.

(56) References Cited

U.S. PATENT DOCUMENTS

| | | | | |
|---|---|---|---|---|
| 1,825,916 A | | 10/1931 | Mock | |
| 1,873,508 A | | 8/1932 | Tanger | |
| 2,335,016 A | * | 11/1943 | Lorenzen ..... | A61J 1/03 206/538 |
| 2,367,573 A | | 1/1945 | Gibson | |

(Continued)

*Primary Examiner* — King M Chu

(74) *Attorney, Agent, or Firm* — Millman IP Inc.

(57) ABSTRACT

A container is provided. The container has a lid and a tray. The lid has a contiguous array of walls extending therefrom. The tray has a recess for receiving soft food material. The recess is sized to receive the array of walls of the lid. The tray has a contiguous array of ridges corresponding to the array of walls of the lid. A top surface of the ridges of the tray contact a bottom surface of the walls of the lid when mated to form sealed compartments. A sealing mechanism is provided along a perimeter of at least one of the lid and the tray sealing the lid and the tray along perimeters thereof, and restricting separation of the bottom surface of the walls of the lid from the top surface of the ridges of the tray when mated. At least one of the lid and the tray is formed from a flexible material so that the lid and the tray can be partially separated to remove a food portion formed in one of the compartments without breaking all of the seals of the compartments.

20 Claims, 3 Drawing Sheets

(56) References Cited

U.S. PATENT DOCUMENTS

| | | | | | |
|---|---|---|---|---|---|
| 3,061,136 | A | | 10/1962 | Sterngart | |
| 4,222,547 | A | | 9/1980 | Lalonde | |
| 4,382,106 | A | | 5/1983 | Royster | |
| 4,412,616 | A | | 11/1983 | Williams | |
| 4,432,529 | A | | 2/1984 | McMillan | |
| 4,671,405 | A | * | 6/1987 | Hagan | B65D 1/24 206/139 |
| 4,887,790 | A | * | 12/1989 | Wilkinson | A61J 3/06 206/531 |
| 5,323,926 | A | | 6/1994 | Pomroy et al. | |
| 5,950,834 | A | | 9/1999 | Woodnorth et al. | |
| 6,758,338 | B2 | | 7/2004 | Lien | |
| 8,596,490 | B2 | | 12/2013 | Davidson et al. | |
| 2007/0107447 | A1 | | 5/2007 | Langlotz | |
| 2013/0175269 | A1 | | 7/2013 | Chen | |

* cited by examiner

SOFT FOOD SHAPING AND STORAGE CONTAINER

This application is a continuation of prior U.S. application Ser. No. 14/804,263 filed on Jul. 20, 2015, the entire contents of both which are incorporated herein by reference.

FIELD OF THE INVENTION

The present invention relates generally to the storage of food. More particularly, the invention relates to a container for storing soft food.

BACKGROUND OF THE INVENTION

Storing frozen food requires the use of a sealed container to protect food from freezer burn. Freezer burn occurs when cold, dry air reaches the food's surface, causing water vapor to sublimate out of the food product. Storing food in sealed, individual portions is ideal, but can be inconvenient, time-consuming and space-inefficient if the container does not conform exactly to the food shape.

SUMMARY OF THE INVENTION

According to an aspect of the invention, there is provided a container comprising:

a lid having a contiguous array of walls extending therefrom; and a tray having a recess for receiving soft food material, the recess sized to receive the array of walls of the lid, the tray having a contiguous array of ridges corresponding to the array of walls of the lid, a top surface of the ridges of the tray contacting a bottom surface of the walls of the lid when mated to form sealed compartments; and a sealing mechanism along a perimeter of at least one of the lid and the tray sealing the lid and the tray along perimeters thereof, and restricting separation of the bottom surface of the walls of the lid from the top surface of the ridges of the tray when mated;

at least one of the lid and the tray being formed from a flexible material so that the lid and the tray can be partially separated to remove a food portion formed in one of the compartments without breaking all of the seals of the compartments.

At least one or both of the walls and the ridges between the compartments can be tapered to facilitate separation of soft food material into the compartments.

Both the lid and the tray can be made of a flexible material.

The compartments can be defined by the array of walls and the array of ridges can be hexagonal.

The array of walls of the lid can fit tightly into the recess of the tray.

The walls of the lid can be sufficiently rigid to push through soft food material when the lid and the tray are being mated.

The sealing mechanism can include an overlapping lip along the perimeter of the tray for receiving and engaging the perimeter of the lid.

The tray can include a pull tab located at a corner thereof to facilitate partial separation of the tray from the lid.

According to another aspect of the invention, there is provided a container for apportioning and freezing soft food material, comprising:

a lid having walls extending from an undersurface thereof; and a tray having a recess for receiving soft food material, the recess sized to snugly receive the array of walls of the lid, a bottom surface of the walls of the lid contacting the tray when mated to form sealed compartments; and a sealing mechanism along a perimeter of at least one of the lid and the tray sealing the lid and the tray along perimeters thereof, and restricting separation of the bottom surface of the walls of the lid from the tray when mated;

at least one of the lid and the tray being formed from a flexible material so that the lid and the tray can be partially separated to remove a food portion formed in one of the compartments without breaking all of the seals of the compartments.

The tray can include ridges corresponding to the walls of the lid, and wherein the bottom surface of the walls of the lid contact a top surface of the ridges of the tray when the lid and tray are mated.

At least one or both of the walls and the ridges between the compartments can be tapered to facilitate separation of soft food material into the compartments.

Both the lid and the tray can be made of a flexible material.

The compartments defined by the array of walls and the array of ridges can be hexagonal.

The sealing mechanism can include an overlapping lip along the perimeter of the tray for receiving and engaging the perimeter of the lid.

DETAILED DESCRIPTION OF THE INVENTION

A container for portioning and storing soft food in accordance with an embodiment of the invention is shown in FIGS. 1 to 6. Soft foods can include, for example, ground meats, cookie dough, sauces, stews, baby food, puddings, etc.

Figure 1:
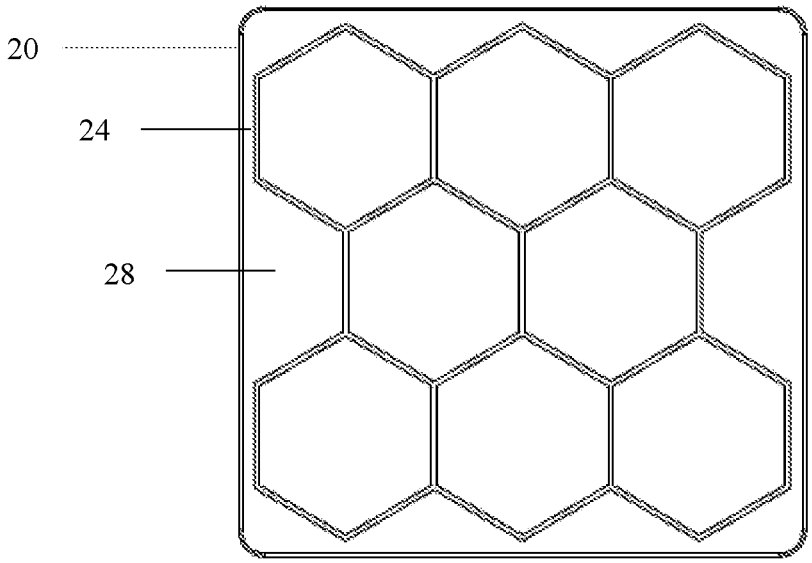
FIG. 1 is a bottom view of a lid of a food storage container in accordance with an embodiment of the invention, the lid having walls in a hexagonal arrangement.
Figure 3:
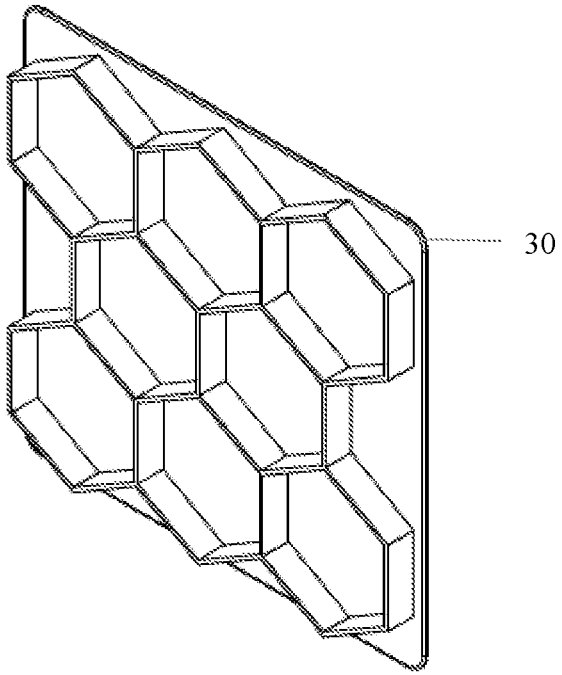
FIG. 3 is a perspective view of the lid of FIG. 1.

FIGS. 1 and 3 show a lid 20 of the container. The lid 20 has an array of walls 24 protruding from a bottom surface 28 of the lid 20 that form identical, contiguous, equilateral and equiangular hexagons. The lid 20 has a perimeter 30. The lid 20 and walls 24 are unitarily made from a flexible plastic.

Figure 2:
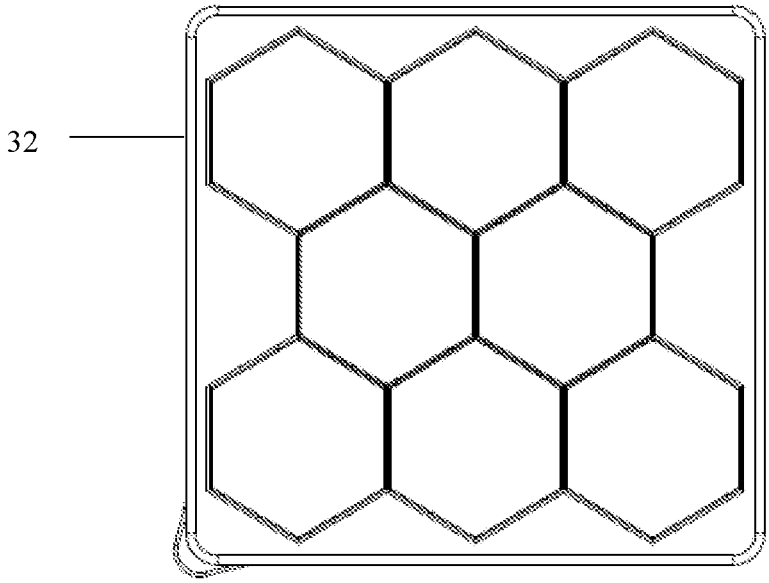
FIG. 2 is a top view of a tray of the food storage container having a set of ridges on a top surface of a recess thereof.
Figure 4:
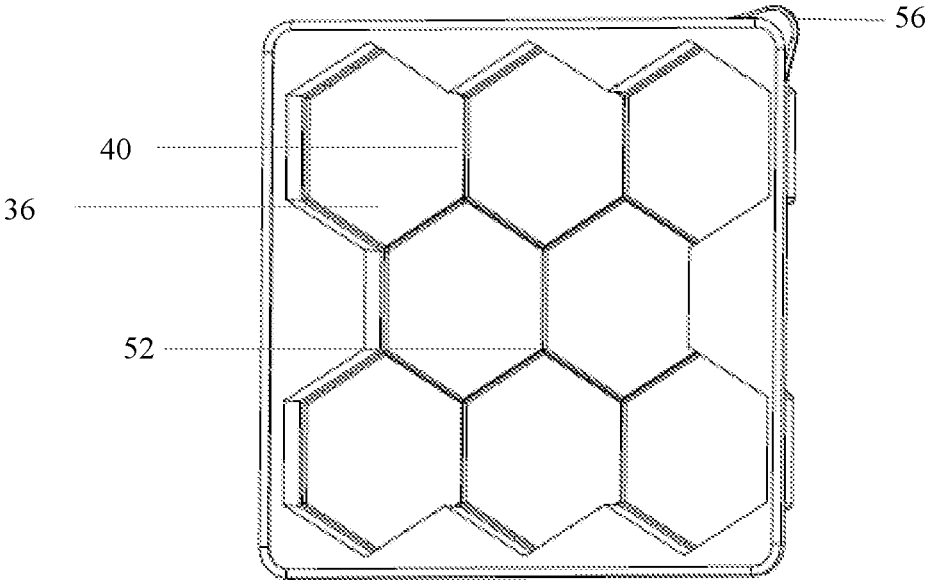
FIG. 4 is a perspective view of the tray of FIG. 2.
Figure 5:
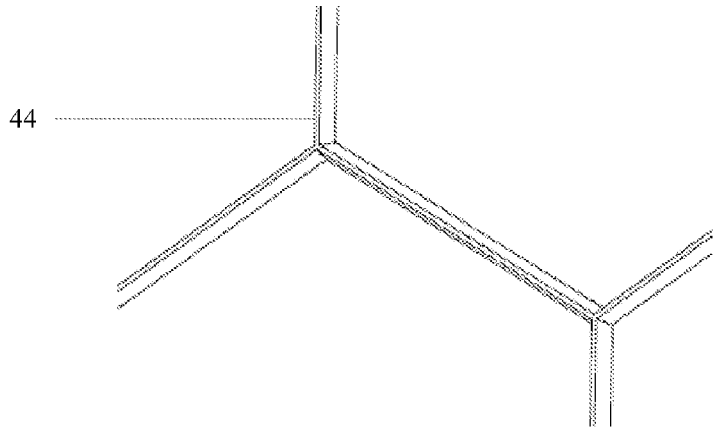
FIG. 5 is a perspective view of ridges along a top surface of the tray of FIG. 2.

FIGS. 2, 4, and 5 show a tray 32 of the container. The tray 32 includes a recess 36 that is dimensioned to tightly/snugly receive the walls 24 of the lid 20. An array of ridges 40 corresponding to the array of walls 24 of the lid 20 protrude from a top surface inside the recess 36 of the tray 32. The ridges 40 are sufficiently rigid to resist bending and deformation, and have tapered edges 44 as shown in FIG. 5.

A sealing mechanism for sealing the lid 20 and the tray 32 about their perimeters is provided by the tray 32 in the form of an overlapping lip 46. The overlapping lip 46 defines a grooved recess dimensioned to receive the perimeter 30 of the lid 20 snugly.

Like the lid 20, the tray 32 and ridges 40 are unitarily made from a flexible plastic.

Now, use of the container will be described with reference to FIGS. 1 to 6. In order to portion and store soft food material using the container, soft food material is spread generally atop of the tray 32 inside the recess 36. The lid 20 is then placed atop of the tray 32 so that the walls 24 slide into the recess 36. As the lid 20 is mated with the tray 32, the soft food material is shaped by the design of hexagonally shaped compartments 48 defined by the lid 20 and its walls 24, and the tray 32 and its ridges 40. The tapered edges 44 on the ridges 40 of the tray 32 provide a cutting action during the mating of the lid 20, and the tray 32. The walls 24 push the soft food material against the tapered edges 44 and acts to separate the soft food material into the compartments 48.

Pushing of the lid 20 into the tray 32 causes bottom surfaces of the walls 24 to contact with the ridges 40 to seal each compartment 48.

Figure 6:
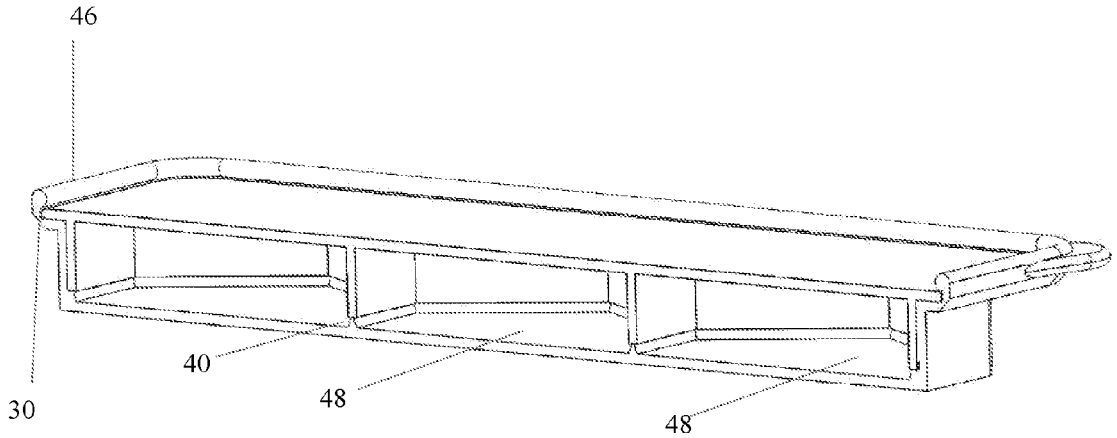
FIG. 6 is a perspective cutaway view of the cross-section of the lid of FIG. 1 and tray of FIG. 2 when mated, showing contact between bottom surfaces of the walls of the tray and top surfaces of the ridges.

Further, as the perimeter 30 of the lid 20 is pushed down, it slips into the grooved recess of the tray 32 defined by the overlapping lip 46. The overlapping lip 46 and the grooved recess of the tray 32 are dimensioned to provide a second seal between the lid 20 and the tray 32 when the perimeter 30 of the lid 20 is received. This is shown in FIG. 6. The overlapping lip 46 holds the lid 20 against the tray 32 so that the bottom surfaces of the walls 24 remain in sealing contact with the top surfaces of the ridges 40.

These two seals (that is, the ones between the walls 24 and the ridges 40 for each compartment 48 and the one about the perimeters of the lid 20 and the tray 32), serve to protect soft food material stored in the freezer from freezer burn. Even if the seal about the perimeter of the lid 20 and the tray 32 is broken, the seals for each compartment 48 generally remain intact. Each compartment 48 is completely self-enclosed, so that each food portion is doubly protected from freezer burn.

The hexagon shaped compartments 48 defined by the lid 20 and the tray 32 are identical, equilateral and equiangular, which enables equally sized shaping of soft food items.

As previously noted, the container lid 20 and tray 32 are entirely made of a malleable plastic that is soft and elastic throughout, including the walls 24. This enables easy separation of the soft food material from the tray 32 and the lid 20 after freezing the food. The plastic is soft enough to be very flexible, even at freezer temperatures. The geometry of the walls 24 in the hexagonal array make them rigid at each vertex 52. Despite being made of a flexible plastic, these rigid vertices 52 make it possible for the tapered ribs 40 of the tray 32 mating with the corresponding walls 24 of the lid 20 to cut through denser foods such as ground beef.

Once filled with food, the sealed container can be placed in a freezer. When the food portions are fully frozen, the container may easily be opened using a pull tab 56 at the corner of the tray 32. The soft plastic material flexes to allow easy removal of food portions, fresh or frozen. By peeling apart the lid 20 and the bottom tray 4 to partially separate them, as many pieces as required may be removed from the container without fully opening it. If the container is not fully opened, at least some of the compartments 48 opposite to the side where the container is being opened can remain sealed, thereby preventing exposure to ambient air of the undispensed food within and minimizing freezer burn. These remaining food portions may be returned to the freezer, each sealed, stored, and protected within their individual storage compartments 48.

The resulting hexagonally shaped food portions may then be transferred to be cooked, typically forming a rounded shape when heated, as in the case of cookies or ground meats.

While the compartments defined by the walls, ridges, and the recess in the above embodiment are described as being hexagonal, those skilled in the art will appreciate that compartments of other shapes can be used. For example, triangular or rectangular compartments can be employed in some cases. Adjustment of the thickness of the walls or the rigidity of the material may be desired to accommodate for the inherent differences in structural strength.

Other types of sealing mechanisms for retaining the lid in sealed relationship with the tray can be employed. For example, hinged clips or a rigid or flexible clamp can be used.

One or both of the lid and the tray can be constructed from other materials. While it may be preferred that the materials be flexible, it can be desirable in some cases to construct the lid and/or tray so that they are articulated; that is, they have flexible or hinged portions.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

We claim:

1. A container comprising:

a first container member;

a second container member having a recess for receiving soft food material;

an array of walls extending from one of the first container member and the second container member into the recess when the first container member is mated with the second container member; and an array of projections corresponding to the array of walls and extending from another of the first container member and the second container member towards the recess when the first container member is mated with the second container member, a surface of the projections contacting a surface of the array of walls when the first container member and the second container member are mated to form sealed compartments;

wherein at least one of the first container member and the second container member is formed from a flexible material so that the first container member and the second container member can be partially separated to remove a food portion formed in one of the compartments without breaking all of the seals of the compartments.

2. The container of claim 1, wherein at least one of the walls and the projections between the compartments are tapered towards the surface to facilitate separation of soft food material into the compartments.

3. The container of claim 2, wherein the projections are tapered towards the surface.

4. The container of claim 2, wherein both the projections and the walls are tapered towards the surfaces.

5. The container of claim 1, wherein both the first container member and the second container member are made of a flexible material.

6. The container of claim 1, wherein the compartments defined by the array of walls and the array of projections are hexagonal.

7. The container of claim 1, wherein the array of walls extends from the first container member and fits tightly into the recess of the second container member.

8. The container of claim 1, further comprising a sealing mechanism along a perimeter of at least one of the first container member and the second container member sealing the first container member and the second container member along the perimeters thereof, and restricting separation of the surface of the array of walls from the surface of the array of projections when mated.

9. The container of claim 8, wherein the sealing mechanism comprises an overlapping lip along the perimeter of one of the first container member and the second container member for receiving and engaging the perimeter of another of the first container member and the second container member.

10. The container of claim 9, wherein the one of the first container member and the second container member comprises a pull tab located at a corner thereof to facilitate partial separation of the first container member from the second container member.

11. The container of claim 2, further comprising a sealing mechanism along a perimeter of at least one of the first container member and the second container member sealing the first container member and the second container member along the perimeters thereof, and restricting separation of the surface of the array of walls from the surface of the array of projections when mated.

12. The container of claim 11, wherein the sealing mechanism comprises an overlapping lip along the perimeter of one of the first container member and the second container member for receiving and engaging the perimeter of another of the first container member and the second container member.

13. A container for apportioning and freezing soft food material, comprising:

a first container member having an array of walls extending therefrom; and a second container member having an array of projections extending therefrom, the array of projections corresponding to the array of walls, a surface of the array of projections contacting a surface of the array of walls when the first container member and the second container member are mated to form sealed compartments;

wherein at least one of the first container member and the second container member are formed from a flexible material so that the first container member and the second container member can be partially separated to remove a food portion formed in one of the compartments without breaking all of the seals of the compartments.

14. The container of claim 13, further comprising a sealing mechanism along a perimeter of at least one of the first container member and the second container member sealing the first container member and the second container member along the perimeters thereof, and restricting separation of the surface of the array of walls from the surface of the array of projections when mated.

15. The container of claim 13, wherein at least one of the array of walls and the array of projections between the compartments are tapered towards the surface to facilitate separation of soft food material into the compartments.

16. The container of claim 15, wherein the array of projections between the compartments is tapered towards the surface.

17. The container of claim 15, wherein both the array of projections and the array of walls are tapered towards the surfaces.

18. The container of claim 13, wherein both the second container member and the first container member are made of a flexible material.

19. The container of claim 13, wherein the compartments defined by the array of walls and the array of projections are hexagonal.

20. The container of claim 14, wherein the sealing mechanism comprises an overlapping lip along the perimeter of one of the first container member and the second container member for receiving and engaging the perimeter of another of the first container member and the second container member.

* * * * *